United States Patent [19]

Mittelmann et al.

[11] Patent Number: 4,493,428

[45] Date of Patent: Jan. 15, 1985

[54] FREIGHT CONTAINER, IN PARTICULAR FOR AIR FREIGHT

[75] Inventors: Gerhard J. Mittelmann, Öhningen; Ricardo W. Liebherr, Engen, both of Fed. Rep. of Germany

[73] Assignee: Schweizerische Aluminium AG (Swiss Aluminium Ltd.), Chippis, Switzerland

[21] Appl. No.: 544,107

[22] Filed: Oct. 21, 1983

[30] Foreign Application Priority Data

Sep. 12, 1983 [DE] Fed. Rep. of Germany ..... 3332797

[51] Int. Cl.[3] ..... B65D 88/16

[52] U.S. Cl. ..... 220/1.5; 220/72; 220/75

[58] Field of Search ..... 220/1.5, 4 F, 72, 74

[56] References Cited

U.S. PATENT DOCUMENTS

| | | | |
|---|---|---|---|
| 2,086,747 | 7/1937 | Stetson | 220/1.5 |
| 2,613,836 | 10/1952 | Newhall et al. | 220/1.5 |
| 3,910,446 | 10/1975 | Dougherty | 220/1.5 |
| 4,046,278 | 9/1977 | Chieger et al. | 220/72 X |
| 4,181,237 | 1/1980 | Kenyon et al. | 220/75 X |

FOREIGN PATENT DOCUMENTS

| | | | |
|---|---|---|---|
| 6410931 | 3/1966 | Netherlands | 220/1.5 |

*Primary Examiner*—Steven M. Pollard
*Attorney, Agent, or Firm*—Bachman and LaPointe

[57] ABSTRACT

A freight container (1), in particular a lightweight container (1) for air freight, having a support frame structure (3) which is secured to a container bottom (2) and which is formed from shaped bars or like strut members and which is at least partially covered or clad by a skin formed by sheet metal plates, fabric means or the like flat members, with a door (35) being provided within at least one area of the frame, is to be improved in such a way that it can be converted without cost into a so-called fork lift version and can also be restored to the normal version.

For that purpose, provided in the interior (30) of the container, on the bottom plate (2), is an intermediate bottom member (52, 73) having channel-like shaped members (53; 72; 73) on its underside, the intermediate bottom member being releasably connected to the bottom plate and/or the support frame structure (3). In addition, the intermediate bottom member is preferably to be provided with U-shaped members (53), the free limb portions of which are bent over at a spacing (q) from the underside of the intermediate member to form support web portions (54), with the latter being directed away from the interior (55) of the shaped members.

14 Claims, 14 Drawing Figures

Figure 1:
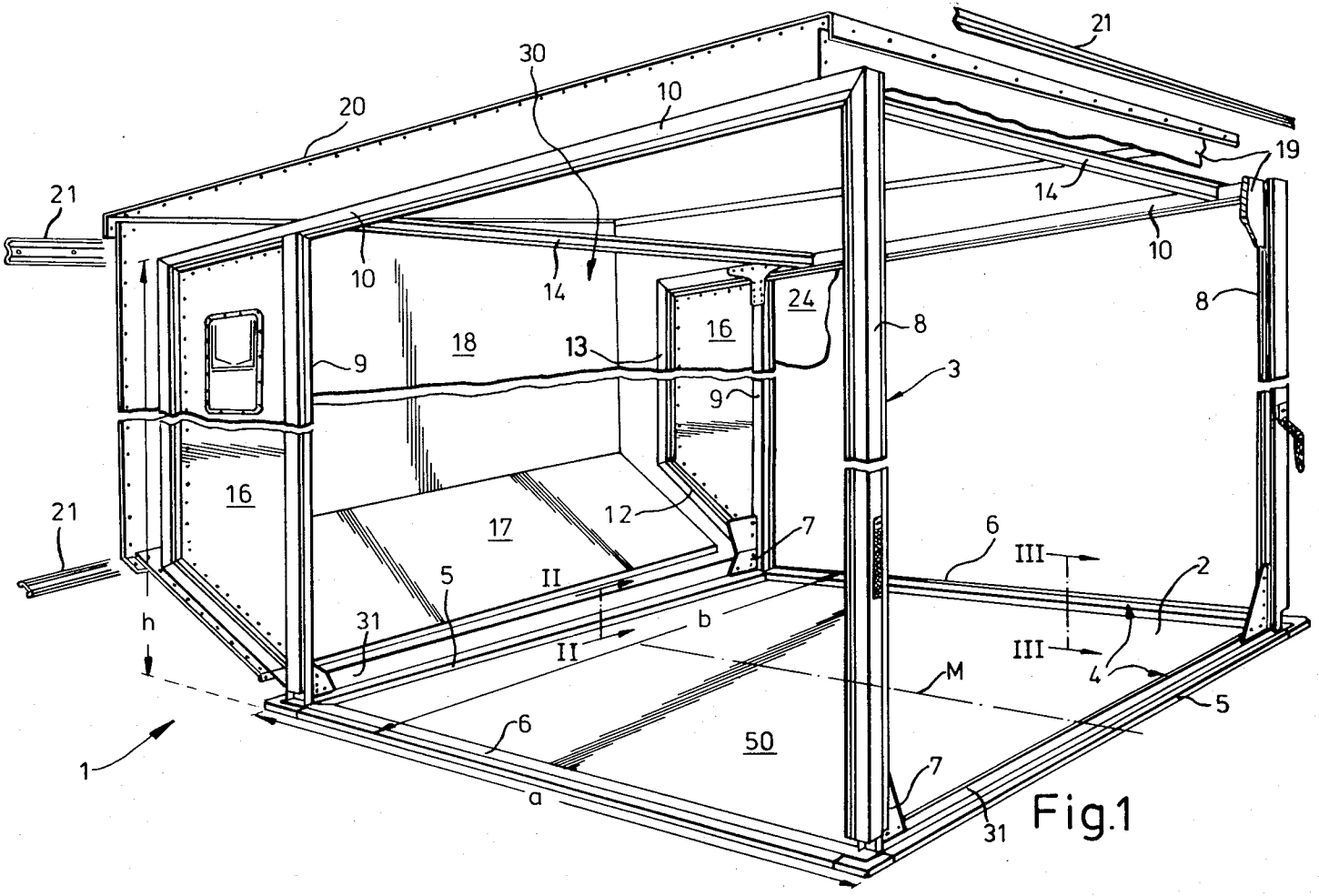

5
31
32

6
2
33
32

24
25
26
38

24
26
27
V
V

FREIGHT CONTAINER, IN PARTICULAR FOR AIR FREIGHT

The invention relates to a freight container, in particular a lightweight container for air freight, comprising a support frame structure which is secured to a bottom or base plate and which is formed from shaped bars or like strut members and which is at least partially covered or clad by a skin formed by sheet metal plates, fabric means or the like flat members, with a door being provided within at least one area or panel of the frame.

Flight containers of that kind are known for example from a publication from the present applicants ('Miteinander', issue 4, 1980); the bottom or base plate, which is almost square, carries the skeleton-type support frame structure which is made up of shaped bars that extend at a right angle to the base plate, and ridge and transverse members which connect the ends of the bars. At one side of the base plate, the ridge members project beyond the base plate and are part of an extension on the container, having an upwardly inclined floor or base portion. When the flight container is in position in an aircraft, the upwardly inclined floor portion is directed towards the wall of the aircraft, and is substantially adapted to the curvature thereof.

Flight containers of that kind are usually taken to the aircraft on roller-type transportation trucks and are pushed from the load-carrying surface of the truck into the freight compartment in a horizontal direction. It is also possible however for individual flight containers to be loaded using fork lift trucks; a version of the container of a particular configuration, which is referred to as a fork lift version, is used for such a purpose. The fork lift version of the container has structures referred to as pockets, under the base plate thereof, the pockets providing a channel-like space therewithin for receiving the fork limbs or prongs of the fork lift truck.

As, for evident reasons, the contours of containers are standardised, with the above-described fork lift version, the support frame structure must be shorter than the support frame structure of the freight container referred to above, in order to compensate for the height of the pockets of the fork lift version; the fork lift version and the flight containers which are used with roller-type trucks must be produced differently as the components thereof are not interchangeable. For reasons of space, it is not possible exclusively to use flight containers for the fork lift mode of operation, so that hitherto all airline companies use at least the two different versions of containers described above, with all the disadvantages involved therein, namely the above-mentioned extensive storage required and also the further shortcoming that, when required, generally another kind of container, that is to say, the kind of container which is not required, at that time, is available.

Having regard to the foregoing considerations, the object set by the present inventor was so to inprove a freight container of the general kind set forth in the opening part of this specification, that the disadvantages recognised are eliminated and in particular both versions of container are available, while providing for simplified storage and manufacture, in the respective manner required.

That object is attained in that, in the interior of the freight container as set forth in the classifying portion of the main claim, disposed on the base or bottom plate is an intermediate or false bottom member, having channel-like profile means or shaped members at its underside, and is releasably connected to the bottom or base plate and/or to the support frame structure. Such an intermediate bottom member makes it possible for the freight container to be prepared for use as a fork lift-type container, with a small number of manual operations involved, without requiring alteration in the dimensions of the container or even the use of a different container design. In addition, storage in respect of containers which are ready for use, and spare parts, is reduced to an extremely high degree.

The so-called fork lift attachment preferably comprises a bottom or base plate, the intermediate bottom member and U-shaped members which are secured thereto and the free limb portions of which are bent over at a spacing from the underside of the intermediate bottom member to form support web portions which, in the fork lift version, are supported on the bottom plate of the container, while the top side of the intermediate bottom member forms the load-carrying surface in the interior of the container.

In particular cases, instead of using such a light fork lift attachment, it is possible to use a compact shaped member which comprises two wall portions with web portions holding them at a spacing; in that case, the spaces between the web portions of the shaped member form insert spaces for the prongs or limbs of the fork lift truck. In that way, it is possible to use inserts which are produced in one piece, in the freight container according to the invention.

Especially in the case of the one-piece insert, it has been found desirable for shaped members to be provided on both sides of the door of the container and the bottom or base plate, said shaped members, parallel to the base plate, forming an insertion track means for insertion of the intermediate bottom member, that is to say, the fork lift attachment. That arrangement means that the conversion operation is limited to taking a very short period of time.

It will be appreciated that the fork lift attachment or the one-piece insert can be connected to the container in a different manner, the essential consideration being that it can be quickly released and can be locked in place.

The comparatively small height of the fork lift attachment or insert is compensated for, by means of a small number of simple operations, when converting the container, both at the door and also at the rear panel which is opposite to the door. The simple operations referred to can be carried out, by virtue of further features according to the invention.

The state of the art includes multi-part doors which are primarily pivoted to the roof or ridge member and which can be folded, parallel to the bottom or base plate. In accordance with the invention, foldable doors of that kind are distinguished in that the width of a gap which is present between the portions of the door at least corresponds to the height of the attachment or insert member and is closed by a flexible strip of material. At its longitudinal edges, the strip of flexible material advantageously has edge bead portions or retaining bead portions which are releasably mounted in receiving channels or grooves in the door portions. That arrangement provides that, by virtue of reducing the size of the above-mentioned gap between the portions of the door, the door can be adapted in respect of its length to the attachment, and can be increased in length again, after the attachment has been removed. Unfortunately, due to customs regulations, it is necessary for hinges of different lengths to be riveted in place in each case, and to be suitably replaced after the rivets have been removed, in order to adjust for the difference in height.

When altering the width of the above-mentioned gap, it is also possible for the strip of material to be replaced by another strip of a different width. When moreover it was stated that the width of the gap between the door portions corresponds to the height of the attachment, that obviously applies in regard to the condition before the reduction in size, which is made necessary by virtue of use of the attachment, and only insofar as the sum of the widths of the gaps in the door must correspond to the height of the attachment.

The above-mentioned receiving channels or grooves are parts of shaped bar members which, according to the invention, extend at least at the longitudinal edges of the door portions but which preferably form the frame thereof. In that case, the receiving channels or grooves which are disposed at the outward edges of the door are used for the insertion of corresponding bead portions of lip-type sealing members. The shaped members used therefore in turn result in the container doors being very advantageous in regard to handling and equipment or layout.

In accordance with the invention, the back panel which is disposed opposite to the container door, in the normal version of the flight container, has a shaped bar member at its lower edge, the bar member connecting the edge of the panel to the bottom or base plate or to a hollow member which delimits same.

If an attachment member is to be fitted into place, the shaped bar member is removed and replaced by an angle member which rests with one limb portion on the attachment and which bears with the other limb portion against the back panel. The angle member of component is preferably part of the attachment, and is therefore stored or transported therewith.

It will be appreciated that, when converting the flight container, only the shaped bar member of the back panel has to be removed or replaced.

In all therefore, the invention provides a novel flight container with the attachment or insert as an additional component, which can be readily used both as a standard container, and also for use with fork lift trucks, with a reduced storage requirement and a short conversion time.

Figures 2, 3, 4, 5:
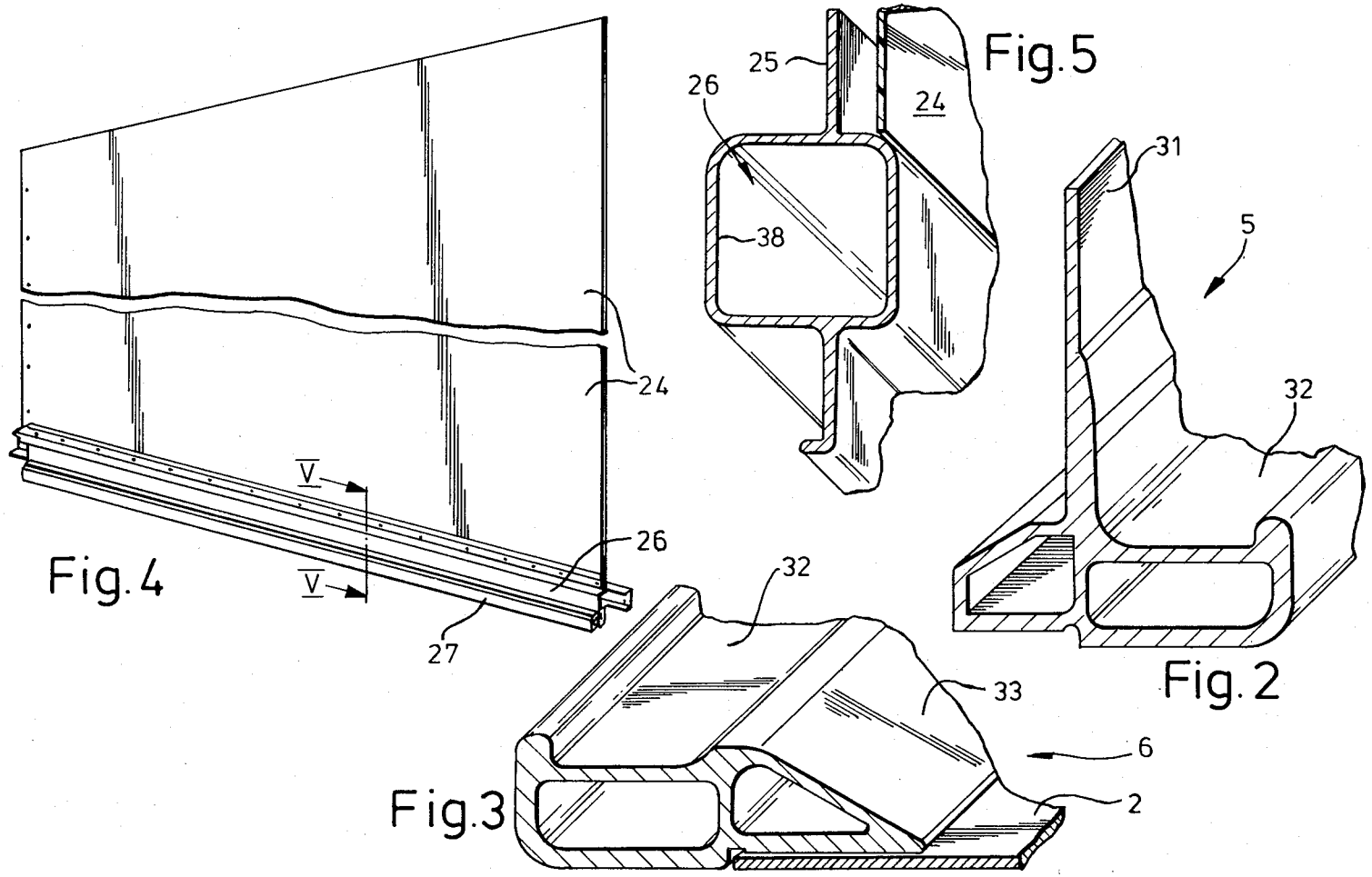
Figure 7:
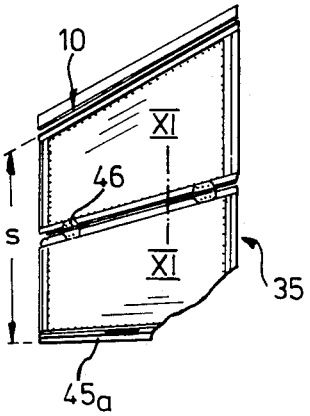
Figure 6:
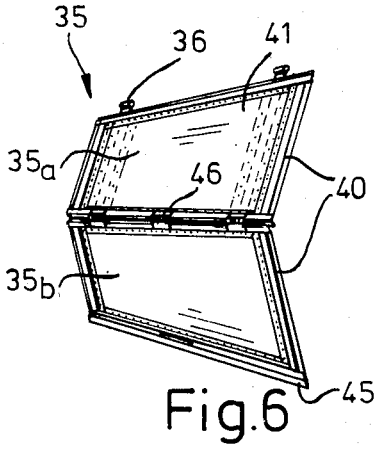
Figure 13:
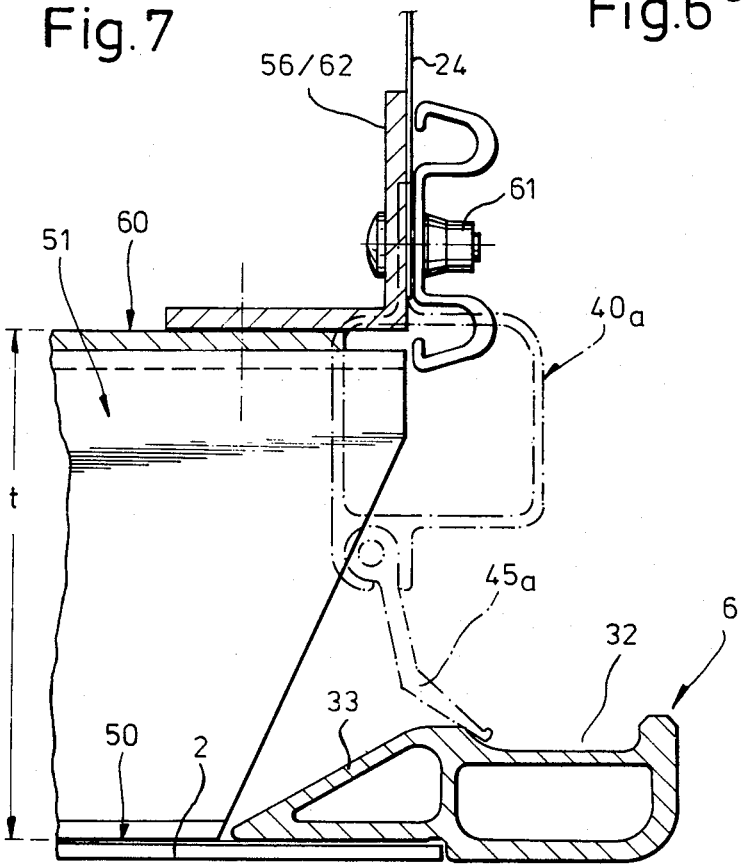
Figures 8, 10:
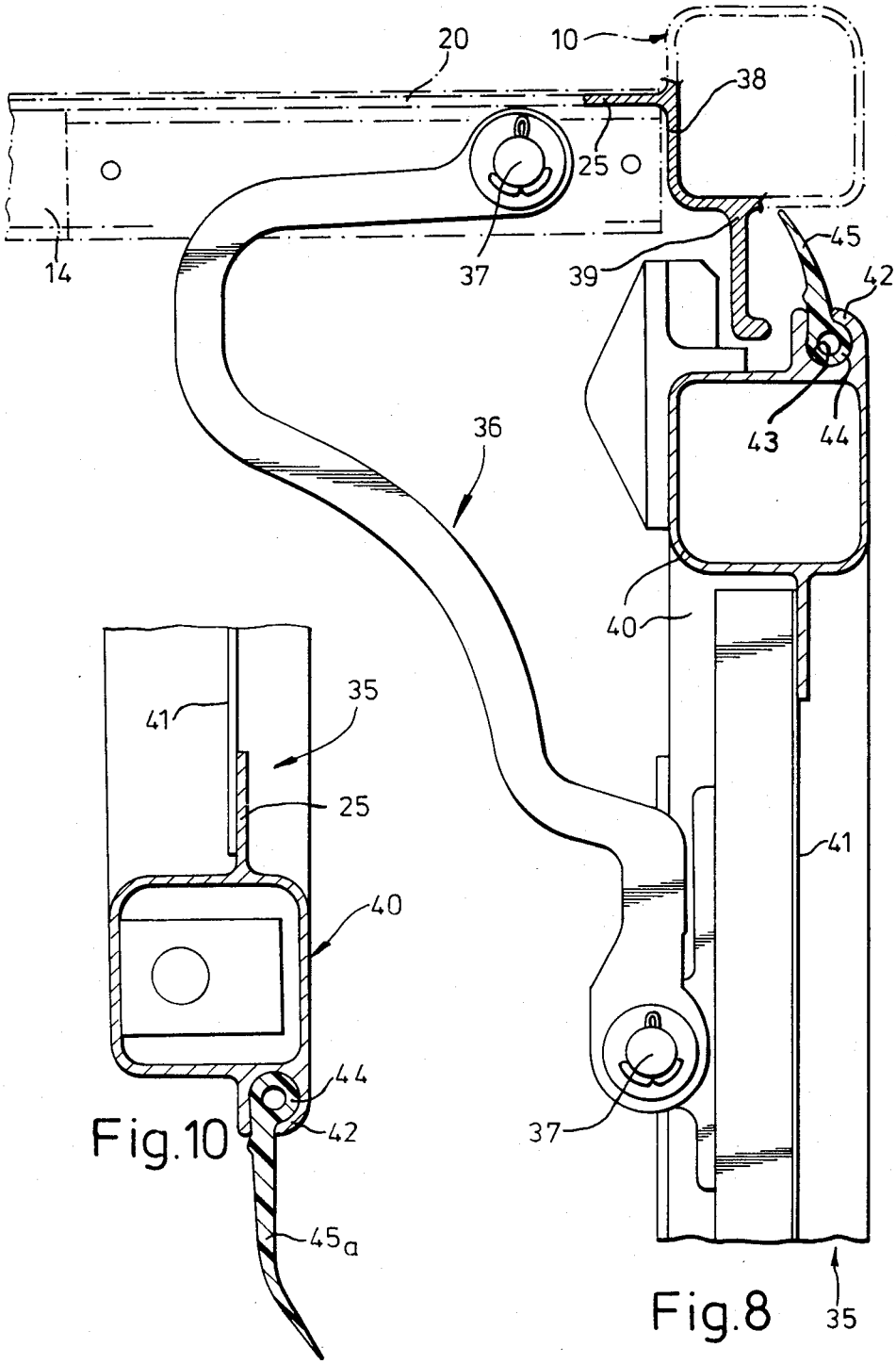
Figure 11:
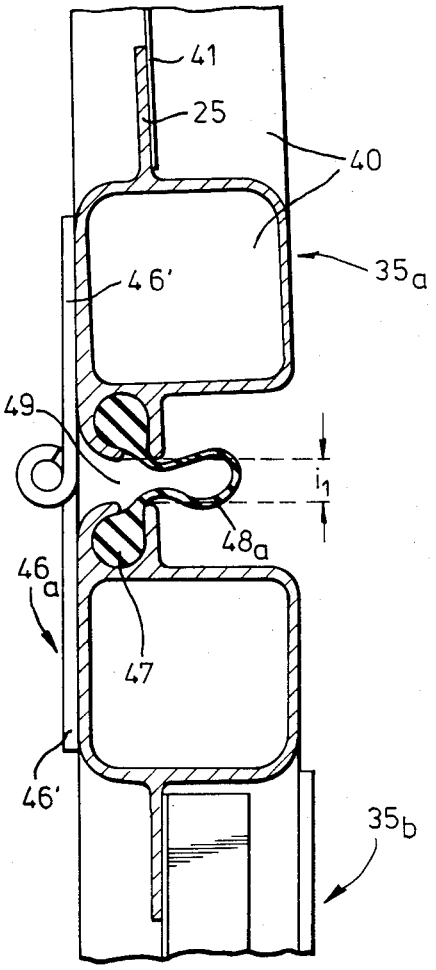
Figure 9:
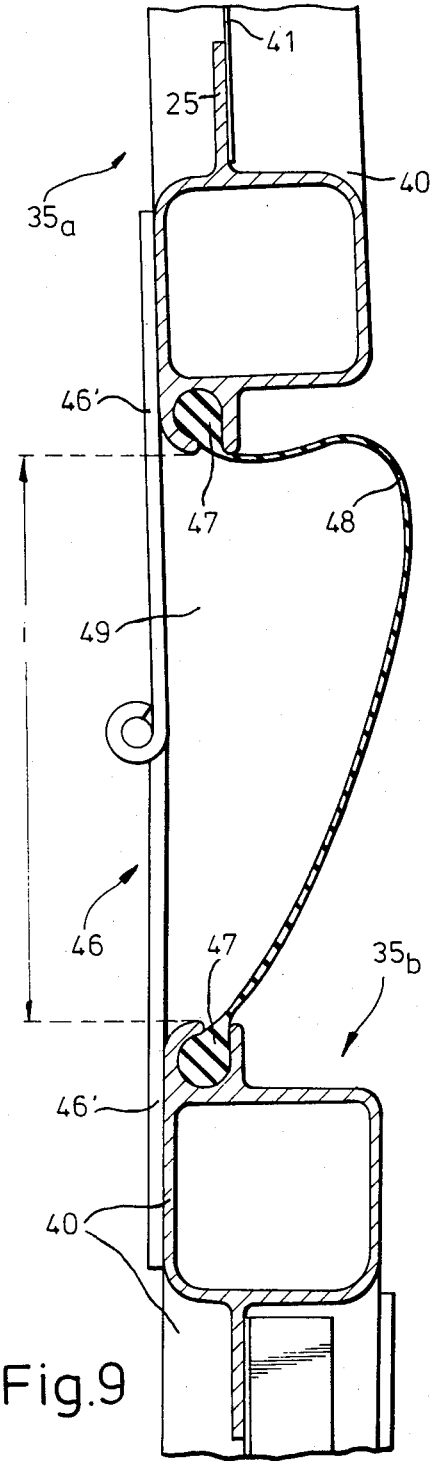
Figures 12, 14:
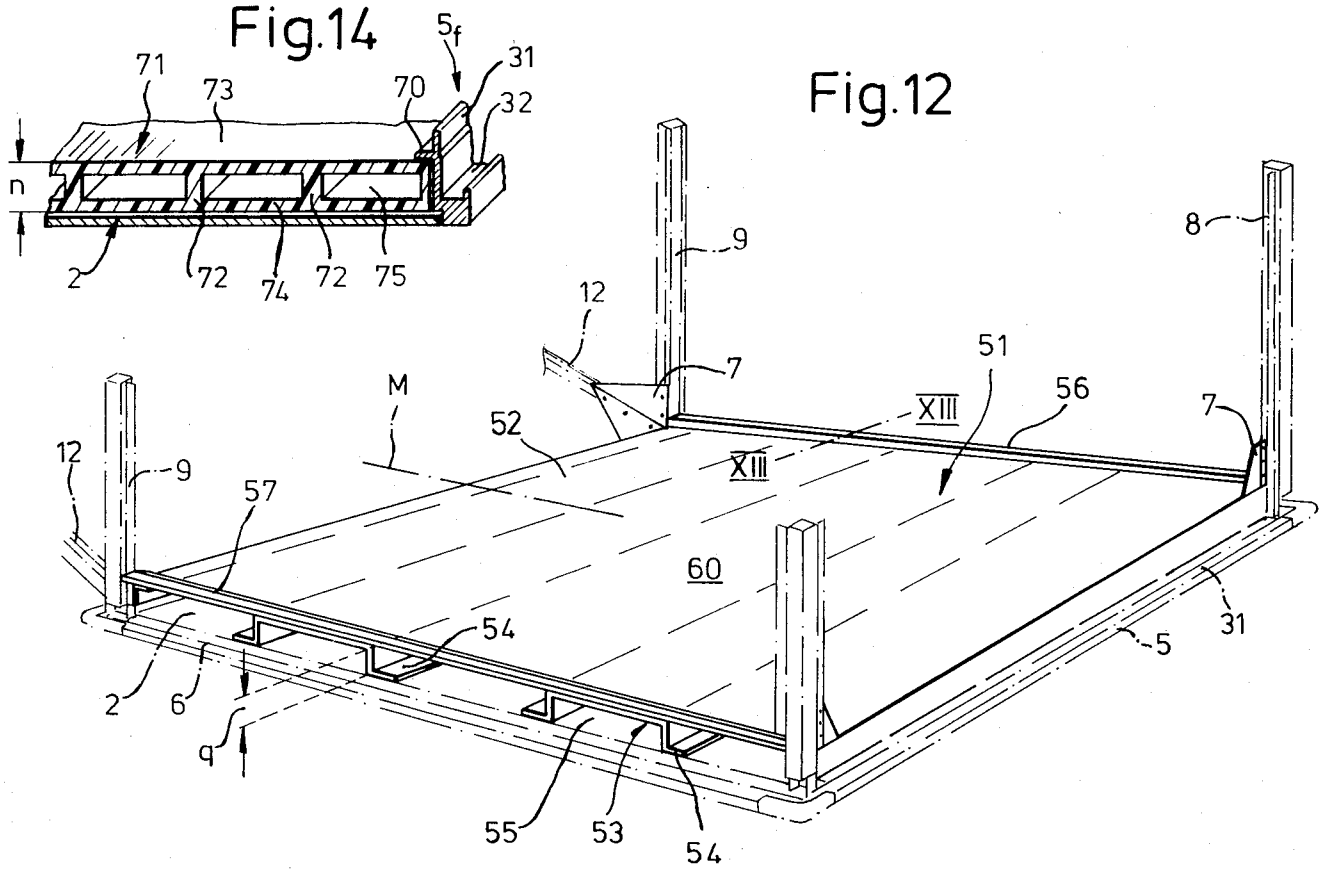

Further features, advantages and details of the present invention will be seen from the following description of preferred embodiments and with reference to the drawings in which:

FIG. 1 is a diagrammatic perspective view of a freight container, illustrated in a partly exploded form, FIG. 2 shows a perspective view on a larger scale of a detail from FIG. 1, taken in section along line II—II, FIG. 3 shows a perspective view on an enlarged scale in section taken along line III—III in FIG. 1, of another detail thereof, FIG. 4 shows a perspective view of a supplementary detail of the container shown in FIG. 1, FIG. 5 shows a detail view on an enlarged scale of part of FIG. 4, in section taken along line V—V in FIG. 4, FIG. 6 shows a perspective view of a pivotable or folding container door, FIG. 7 shows a part of the container door in the unfolded condition, FIG. 8 shows a view on a large scale than in FIG. 7 and in cross-section through part of the container door and an adjoining portion of the container, FIG. 9 shows a view on a larger scale of part of the structure shown in FIG. 7, taken in section along line XI—XI therein, FIG. 10 shows a view on an enlarged scale and in cross-section through the end of the container door, which is the lower end in the installed position thereof, FIG. 11 is a view corresponding to that shown in FIG. 9 of the detail shown therein, in another position of installation, FIG. 12 shows an attachment means which is releasably arranged in the container, FIG. 13 shows a view on an enlarged scale of part of the container provided with the attachment shown in FIG. 12, in cross-section substantially along line XIII—XIII in FIG. 12, and FIG. 14 shows a sectional view of a detail of another embodiment of the container.

A freight container 1 which is used in particular as a light container for transportation by air has a support frame structure 3, over a bottom or base plate 2. A bottom or base frame 4 surrounds the base plate 2, and, in the illustrated embodiment, is of a length a of 1534 mm and a width b of 2003 mm. The base frame 4 comprises hollow shaped members 5 and 6 and from same project, inter alia, shaped bar members 8 and 9 which are also hollow and which are secured to corner plates 7. Respective pairs of bar members 8 and 9 are joined together by means of roof or ridge shaped members 10 which extend parallel to the longitudinal axis M of the container, to form a side frame with an overall height h of 1623 mm, in this embodiment. The side frame also includes a frame area which is clad by a sheet metal panel 16 and which has an inclined support or base member 12, as well as a shaped end member 13 which extends between the shaped member 12 and the ridge member 10.

Stiffening transverse members 14 are disposed between the two ridge members 10.

An inclined base strip portion 17, a short outer panel member 18, a high end wall portion 19 and a roof panel 20 are secured, preferably by riveting, to the support frame structure 3, and are strengthened by externally disposed shaped edge members 21.

The side frame structure 4, 7, 8 and 10 of the container 1, which is at the rear in the view shown in FIG. 1, is closed by a back panel 24 which is shown in FIG. 4 and which is riveted to the bar members 8 and 9 and the ridge member 10 as well as to a flange or web portion 25 of a shaped base member 26. The member 26 is fitted with a sealing strip 27 on to the shaped hollow member 6 of the base frame 4, the sealing strip 27 being omitted from FIG. 5 for the sake of enhanced clarity of the drawing.

The hollow members 5 and 6 of the base frame 4 are shown in FIGS. 2 and 3. At its top, beside a securing limb portion 31, the member 5 is provided with an insert groove 32. The other hollow member 6 also has such an insert groove 32 and, along same, a lip 33 which is formed on the hollow member and which is directed towards the interior 30 of the container, as well as being inclined with respect to the base plate 2.

The side of the container 1 which is towards the person viewing FIG. 1 is closed by a multi-part, foldable door 35 which is connected to the transverse members 14 by means of hinges or by other holding members 36, at both ends thereof, by way of hinge pins 37, with the door 35 possibly being connected directly to the ridge member 10 to which the transverse members 14 and the roof panel 20 are connected by means of a lateral flange or web portion 25 on the ridge member 10. An edge or flange portion 39 projects towards the door 35 from the box-like body portion 38 of the shaped member 10, at an angle of 90° to the above-mentioned flange portion 25, to bridge the gap between the body portion 38 of the ridge member 10 and the adjacent edge of the door.

The doors 35 are made up of a plurality of frame arrangements formed from shaped edge members 40 of the same cross-section, and planks 41 which are connected to flange portions 35 of the members 40, within the frame structures. Formed on the member 40, at the side which is remote from the flange portion 25, is an edge beam mounting or a receiving channel 42 which provides a space 43 which by definition is of an undercut configuration, for receiving the bead portion 44 of a lip-type sealing member 45. Such sealing members 45 can be seen in FIGS. 8, 10 and 13, wherein the sealing lip portions 45*a* which face towards the bottom of the arrangement are of a longer cross-section than those at the upper edge of the door 35.

FIGS. 6 and 8 show that two door members 35*a* and 35*b*—or, in other embodiments, a larger number thereof—are joined together by other hinges 46, the flap portions 46' of which are non-releasably secured to the respectively adjacent member 40, for reasons concerning customs regulations. In order to replace or exchange the hinges 46, it is necessary to remove rivets (not shown in the drawings).

The members 40 which are provided with the hinges 46 accommodate, in their mutually facing channels or grooves 42, retaining beads 47 provided at the respective edges of a concertina-type sealing member or expansible sealing arrangement 48 which covers over a gap 49 between the door portions, of a height i. As can be readily seen from adjoining FIGS. 9 and 11, the sealing member 48 is replaceable or interchangeable.

For the purposes of being transported by fork lift trucks, the above-described container 1 is converted to what is referred to as the fork lift version, that is to say, an arrangement referred to as a fork lift attachment or insert 51 (see FIG. 12) comprising a cover panel or plate 52 and U-shaped members 53, is laid on to the surface 50 of the base plate 2. The U-shaped members 53 hold the cover panel or plate 52 at a spacing q from the base or bottom plate 2. The cover plate or panel 52 has a strengthening angle member 56 at its rearward end, and a shaped bar member 57 which corresponds to the hollow member 5, which is then parallel thereto, of the base frame 4. The angled limb portions of the U-shaped members 53 rest on the surface 50, by means of their support web portions 54. The space 55 inside each U-shaped member 53 forms a pocket for receiving the prongs of a fork lift truck (not shown in the drawings).

So that the fork lift attachment or insert 51 can be easily inserted and likewise removed again, it is necessary to reduce the height s of the door, for which purpose, as shown in FIG. 11, use is made of shorter hinges 46*a* and a narrower sealing member 48*a*. For reasons concerned with storage and stock-keeping, it is more advantageous, instead of changing the door 35, to change only the hinges 46 thereof, by fitting shorter hinges 46*a*, when the container 1 is being converted from the normal version shown in FIG. 1 into the above-described fork lift version. The difference in length between the height i of the gap as shown in FIG. 9 and the shorter distance $i_1$ in FIG. 11 substantially corresponds to the difference in height t between the surface 50 of the base or bottom plate 2 and the surface 60 of the fork lift attachment or insert 51 (see FIG. 13).

The back panel 24 is adapted either by removal of the base member 26 or, in another embodiment, by an alteration which is diagrammatically illustrated in FIG. 13. When making that alteration, a shaped edge member 40*a* which is also provided on the back panel 24 is removed therefrom by releasing the pins or bolts 61 and it is replaced by an angle bar member 62 which is secured to the fork lift attachment 51 during the period of use thereof, or by means of the shaped angle member 56 thereof.

The securing elements which hold the fork lift attachment 51 in the interior 30 of the container are not shown specifically in the drawing, as they can be readily arrived at, on the basis of the knowledge of the average man skilled in the art. For a particular embodiment as illustrated in FIG. 14, shaped hollow members 5*f* which extend between the door 35 and the back panel 24 are provided, with rib portions 70 which are directed towards the interior 30 of the container; inserted between the rib portions 70 and the bottom or base plate 2 is a one-piece insert member 71, preferably an extruded hollow member, the height n of which corresponds to the above-mentioned distance t between the surfaces 50, 60 of the bottom or base plate 2 and the fork lift attachment 51. The insert 71 comprises two shaped wall portions 73 and 74 which are connected together by web portions 72. The web portions 72 laterally define insertion passages 75.

We claim:

1. A freight container, in particular a lightweight container for air freight, comprising a support frame structure which is secured to a container bottom and which is formed from shaped bars or like strut members and which is at least partially covered or clad by a skin formed by sheet metal plates, fabric means or the like flat members, with a door being provided within at least one panel of the frame, characterized in that an intermediate bottom member having channel-like profile means at its underside is provided in the interior of the container on the bottom plate, and is releasably connected to the bottom plate and/or to the support frame structure.

2. A freight container as set forth in claim 1 characterized in that the intermediate bottom member is provided with U-shaped members, the free limb portions of which are bent over at a spacing (q) from the underside of the intermediate bottom member to form support web portions.

3. A freight container as set forth in claim 2 characterized in that the support web portions of the U-shaped members are directed away from the interior of the shaped member.

4. A freight container as set forth in claim 1 characterized in that web portions hold the intermediate bottom member at a spacing from a parallel plate of one-piece insert member.

5. A freight container as set forth in claim 1 characterized in that the bottom plate thereof is provided on both sides with shaped members which form an insertion track means for the intermediate bottom member.

6. A freight container having a multi-part door which is foldable parallel to the bottom plate and hinges or the like connecting the portions of the door, as set forth in claim 1, characterized in that the width (i) of a gap which is present between the portions of the door at least corresponds to the height (t) of the attachment member and the gap is closed by a flexible strip of material.

7. A freight container as set forth in claim 6 characterized in that the strip of material is provided at both longitudinal edges with edge bead portions which are mounted in edge channels of the door portions.

8. A freight container as set forth in claim 7 characterized in that the channels are formed on shaped bar members which form at least the longitudinal edges of the door portions.

9. A freight container as set forth in claim 7 characterized in that the door portions have a frame comprising shaped bar members and planking or cladding which clad same.

10. A freight container as set forth in claim 7 characterized in that a sealing lip projects from at least one outside edge of the door, which sealing lip is disposed at one end in the channel of the shaped bar member.

11. A freight container as set forth in claim 6 having a rear panel which is disposed opposite to the door, characterized in that the rear panel is provided with an exchangeable zone, the width of which corresponds to the height (t) of the attachment member.

12. A freight container as set forth in claim 11 characterized in that at its lower edge the back panel is provided with a shaped edge member, as the exchangeable zone.

13. A freight container as set forth in claim 11 characterized in that, at its lower edge, the back panel is provided with a connecting means for an angle member.

14. A freight container as set forth in claim 13 characterized in that the angle member is secured to the attachment member by a limb portion of the angle configuration.

* * * * *